US007185385B2

(12) United States Patent
Kohler

(10) Patent No.: US 7,185,385 B2
(45) Date of Patent: Mar. 6, 2007

(54) LOTION APPLICATOR DEVICE

(76) Inventor: Ed G. Kohler, Little Flower Parish, P.O. Box 529, Browning, MT (US) 59417

( * ) Notice: Subject to any disclaimer, the term of this patent is extended or adjusted under 35 U.S.C. 154(b) by 537 days.

(21) Appl. No.: 10/140,126

(22) Filed: May 7, 2002

(65) Prior Publication Data

US 2003/0208864 A1 Nov. 13, 2003

(51) Int. Cl.
*A45D 34/00* (2006.01)

(52) U.S. Cl. ..... 15/104.001; 15/245; 15/245.1; 132/320; 601/137

(58) Field of Classification Search ..... 15/245.1, 15/236.01, 236.07, 104.001, 236.05, 236.06, 15/236.09, 245; 132/320, 317; 401/6, 40, 401/261; D28/7, 91.2; D24/119; 601/137, 601/138

See application file for complete search history.

(56) References Cited

U.S. PATENT DOCUMENTS

| | | | | | |
|---|---|---|---|---|---|
| 1,434,744 | A | * | 11/1922 | Hibbler | 30/169 |
| 2,188,114 | A | * | 1/1940 | Hubbard | 15/245 |
| D129,393 | S | | 6/1941 | Hensley | |
| 2,591,301 | A | * | 4/1952 | Schacht | 15/245 |
| 2,699,565 | A | * | 1/1955 | Brough | 15/245 |
| D190,067 | S | * | 4/1961 | Reedy | D28/7 |
| 3,065,485 | A | * | 11/1962 | Solaini | 15/245 |
| D272,661 | S | | 2/1984 | Cutler | |
| 4,896,984 | A | | 1/1990 | Evans | |
| D306,082 | S | | 2/1990 | Kidd | |
| D310,270 | S | | 8/1990 | Bacal et al. | |
| 5,042,512 | A | * | 8/1991 | Knight | 132/212 |
| D323,409 | S | | 1/1992 | Giese | |
| 5,360,111 | A | | 11/1994 | Arispe | |
| 5,491,869 | A | | 2/1996 | Sullivan | |
| 5,542,144 | A | | 8/1996 | Forsline | |
| 5,566,418 | A | | 10/1996 | Steffen et al. | |
| 5,568,669 | A | | 10/1996 | Godown | |
| 5,664,281 | A | | 9/1997 | Pelfrey | |
| 5,671,497 | A | | 9/1997 | Abdo | |
| 5,673,455 | A | | 10/1997 | Per-Lee et al. | |
| 5,692,261 | A | | 12/1997 | Lops | |
| 5,991,961 | A | * | 11/1999 | Zurik | 15/210.1 |
| D467,686 | S | * | 12/2002 | Kohler | D28/7 |

OTHER PUBLICATIONS

Thomson & Thomson, Trademark Research Report (Back Anointer™), Mar. 29, 2001, pp. 2-8, 16-18, 30, 33-39, 44-52, Thomson & Thomson, North Quincy, Massachusetts.

* cited by examiner

*Primary Examiner*—Mark Spisich
(74) *Attorney, Agent, or Firm*—Gough, Shanahan, Johnson, and Waterman; William L. MacBride, Jr.

(57) ABSTRACT

A device for applying lotion to the human body, the device comprising a handle including a gripping end and a blade member attached at an obtuse angle to the handle and tapered at its edges to which lotion is applied. The blade member is made of a pliable, absorption resistant, silicone rubber compound that more efficiently applies lotion to a user's body and is more easily cleaned.

2 Claims, 3 Drawing Sheets

LOTION APPLICATOR DEVICE

BACKGROUND

The present invention relates to hand-held devices for applying lotions to the human body. In particular, the present invention is an improvement over other devices for applying lotion to a user's hard-to-reach areas of the body.

Applying lotions to the various parts of the body evenly and efficiently is a challenge for many people. Applying lotion to one's back presents a challenge for most people. Additionally, individuals who are unable to bend over or are otherwise limited in body movement will necessarily be unable to easily and efficiently apply lotions to other parts of their bodies, such as their lower extremities.

Hand-held devices used to apply lotions to the human body are known. They do not, however, relieve the challenge of applying lotions evenly and efficiently to various parts of the body for several reasons. First, many devices use a sponge or other absorbent material for the applicator head. Lotion applicator devices using a sponge or other absorbent material for the applicator head are inefficient in applying lotion. Because such an applicator head absorbs the lotion, much of the lotion put on the head does not end up on the user's body. Instead, the lotion soaks into the applicator head. As a result, not only is lotion wasted, but more lotion must be used by the user to gain full coverage of lotion on the desired body part. Because more lotion must be used, the user must purchase lotion more often. When medicated lotion is being used, such purchases can result in excessive cost to the user.

Second, because the sponge or other absorbent material retains lotion, absorbent applicator heads are difficult to clean. Inadequate cleaning may result in the growth of undesirable, and potentially harmful, bacteria on the applicator head. Additionally, because absorbent applicator heads hold lotion and are difficult to clean, if the user uses a device having such a head to apply medicated lotions, the user runs the risk of applying mixed medication lotion to one's self, due to an applicator not thoroughly cleaned, retaining old lotion. Finally, because sponges or other absorbent material cannot be easily cleaned thoroughly, any lotion applicator device using such a head, generally, will be limited to only one user.

Other lotion applicators have further disadvantages. Devices that use a sponge or other absorbent material for the applicator head are often very flimsy, with uneven surfaces, making the resultant lotion application uneven. Flimsy sponge or other absorbent material is often short-lasting, to the point where the heads must be changed frequently. Replacement heads may be costly or difficult to find.

Information relevant to attempts to address some of these problems can be found in U.S. Pat. No. 5,692,261 to LOPS; U.S. Pat. No. 5,566,418 to Steffen, et al.; U.S. Pat. No. 5,664,281 to Pelfrey; U.S. Pat. No. 4,896,984 to Evans; U.S. Pat. No. 5,360,111 to Arispe; U.S. Pat. No. 5,671,497 to Abdo; and U.S. Pat. No. 5,673,455 to Per-Lee, et al.; however, they all disclose hand-held lotion applicator devices having the disadvantage of absorbent applicator heads for applying lotion to a person's body, such heads being made of foam, sponge or other absorbent material.

Each of U.S. Pat. No. 5,491,869 to Sullivan, et al.; U.S. Pat. No. 5,042,512 to Knight; and U.S. Pat. No. 5,542,144 to Forsline do not relate to lotion applicator type of devices for the application of lotion to a person's body. Sullivan's '869 patent discloses a kitchen utensil with a specific, mandatory heat resistant silicone rubber head with a high durometer value that is not substantially flat or planar. Knight's '512 patent discloses a tool for a hair dresser to use an applicator like an artist uses a palette knife, to apply creams or lotions into the hair along the edge of the device, mandated to be used in a manner as a hair dressing comb. Forsline's '144 patent mandates a working surface for its paint brush artist's tool no larger than a maximum cross-sectional diameter of the handle. None of these devices suggest the present invention.

U.S. Pat. No. 5,568,669 to Godown discloses a device that uses a vinyl or other similar material for the applicator head, having an annular depression to control the spread of lotion. However, because the head surface is a pad made with an annular depression, it is not flat or planar and must be depressed against a relatively, large, flat area of the body, such as the back, to work efficiently. The material in the device's head, also, has a low durometer value, making the head flimsy, to accomplish the mandated resiliency, and not as efficient for the application of lotion to hard-to-reach areas of the body.

None of the references mentioned above are admitted to be prior art with respect to the present invention by their mention in this Background section.

There is, therefore, a need for a device that has a pliable blade for applying lotion to hard-to-reach areas of a user's body, which applies lotion in a continuous, uniform manner, does not absorb the lotion and is easily cleaned.

SUMMARY

The present invention is directed to a lotion applicator device that satisfies the needs set forth above, for an applicator to apply lotion to the user's body in a continuous, uniform manner, by an applicator device that does not absorb the lotion and that is easily cleaned.

A lotion applicator having features of the present invention comprises a handle having one end for gripping by the user and an opposing end connected to a blade member. The blade member is made of a pliable, absorbent resistant, silicone rubber compound. The blade member is substantially planar and has tapered edges. Lotion is applied by the user on the underside of the blade member to spread said lotion over hard-to-reach areas of the user's body.

The handle is made of durable plastic. The blade member is connected to the handle at an obtuse angle. The blade member is made of a silicone rubber compound of 40 to 60 durometer value silicone rubber.

It is the object of this invention to provide a device as an applicator for applying lotion to hard-to-reach areas of the body, such as one's back, which applicator delivers lotion efficiently and evenly across the skin surface.

Another object of this invention is to provide an applicator head made of a rubber silicone compound that resists absorption of the lotion in order to maintain efficient application of the lotion.

A further object of this invention is to provide a device that is made of a rubber silicone compound that resists absorption of the lotion in order that the device may be easily cleaned after use. In addition, the present device provides a plastic handle that is connected to the applicator blade at an obtuse angle, the combination of which angle connection and the pliable rubber blade provides a very efficient device for putting lotion on one's back.

In summary, the present invention relates to a device for allowing a person to efficiently apply lotion to hard-to-reach areas of the body and to easily clean the applicator blade surface.

These and other objects will be apparent from the following description and the drawings that are described as follows.

DESCRIPTION

The present invention is an applicator for use in applying lotion to hard-to-reach areas of a user's body. Any type of lotion for the body may be used.

Figure 1:
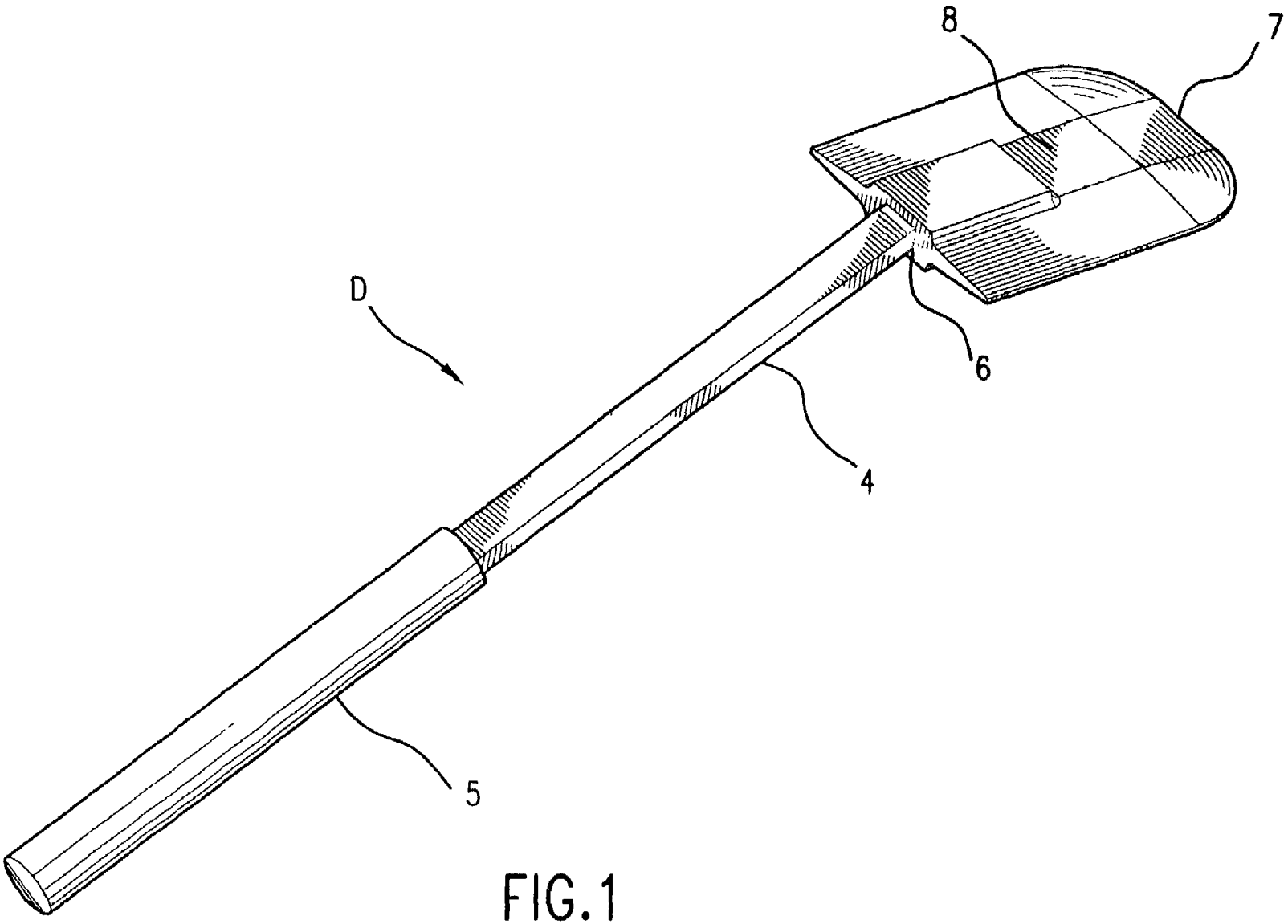
FIG. 1 is a perspective view of the lotion applicator device according to the present invention showing the tapered edges of the blade, the gripping end of the handle and the connection of the blade to the handle in a preferred embodiment.
Figure 2:
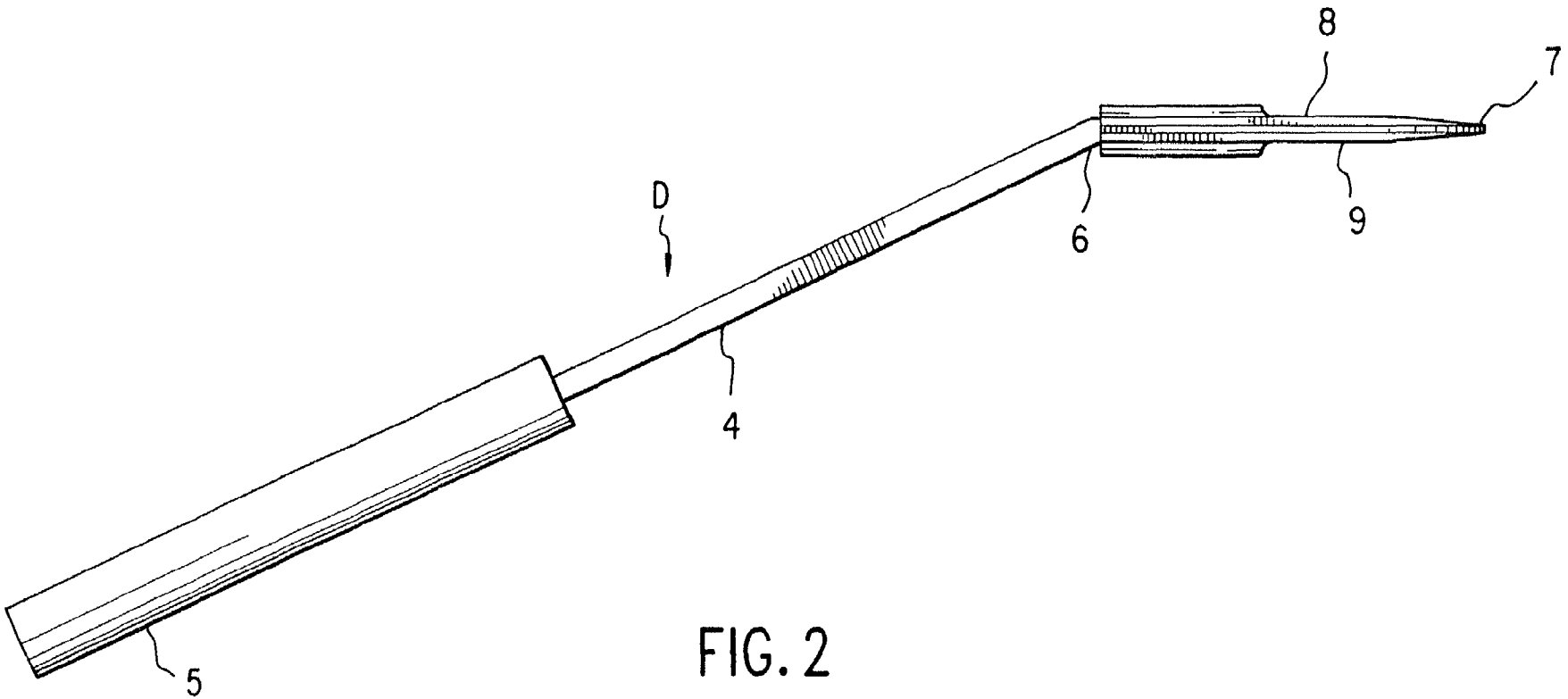
FIG. 2 is a side elevation view of the lotion applicator device according to the present invention showing the obtuse angle from horizontal by which the blade is connected to the handle in a preferred embodiment.

Each of the figures illustrate the lotion applicator device D according to the present version of the invention. As first shown in FIG. 1, the device D includes a handle 4, having a first end 5, configured to be gripped by a user, and a second end 6 adapted to connect to a blade member 7 that will be further described below. The handle is preferably 12 inches (30.48 cm) in length, but may be made in various lengths. The handle can be glued, frictionally fitted or bonded within the blade member, as shown in FIGS. 1 and 2.

Figure 3:
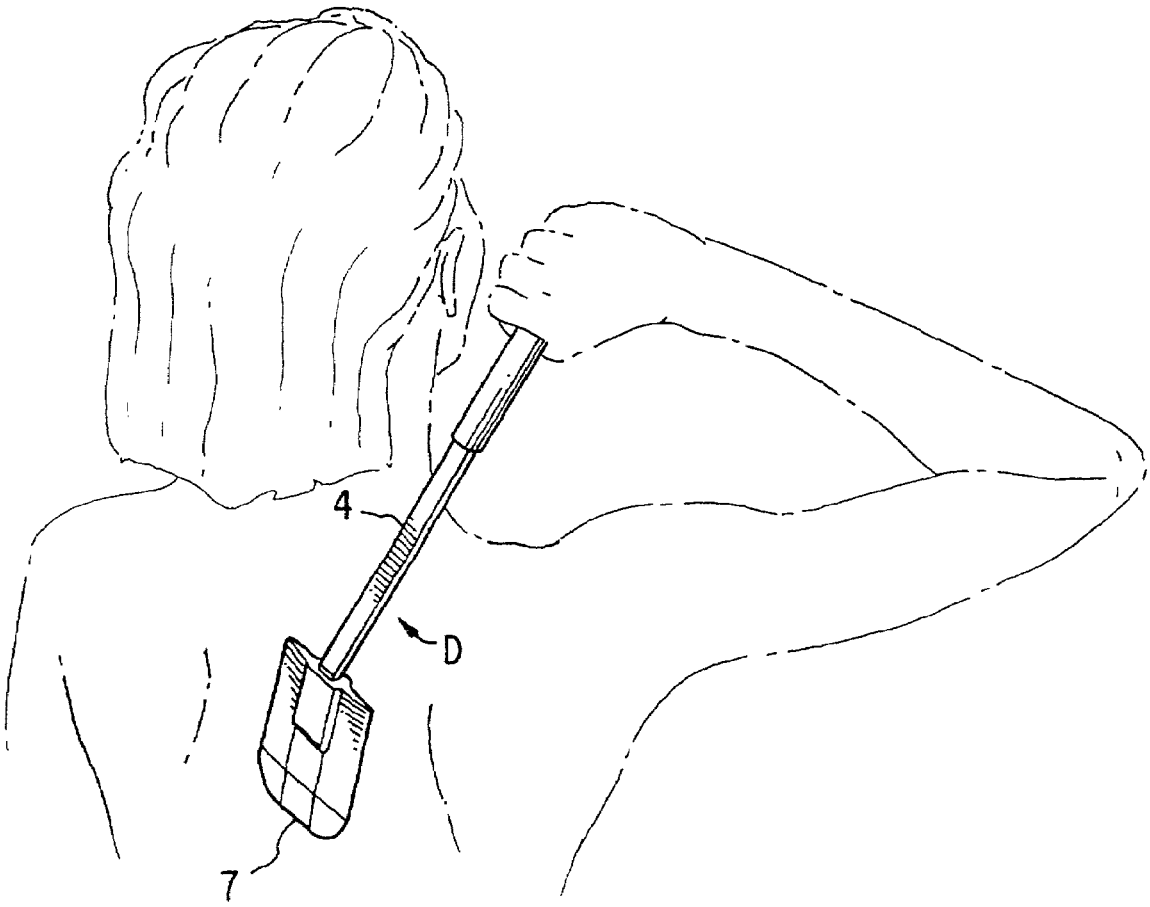
FIG. 3 is a perspective view of the use of the lotion applicator according to the preferred embodiment of the present invention.

The handle of the device D may be made from a variety of materials depending on design considerations such as plastic or wood. For example, the handle 4 can be made of a durable plastic, containing glass reinforced resin, for high durability. As shown in FIGS. 2 and 3, the handle 4 is connected to the blade member 7 at an obtuse angle for the user to most effectively apply lotion to hard-to-reach body areas with said device D, such as the user's back or lower leg areas.

The blade member 7 consists of a pliable, absorbent resistant, silicone rubber compound, made in the preferred embodiment of 40 to 60 durometer value, silicone rubber compound for the most effective pliability and hardness for applying lotion to the body and cleaning the blade member 7. Higher durometer value ratings create a less effective, stiffer and harder blade resulting in less efficient application of lotion and harder cleaning. Lower durometer value ratings create a more flexible, flimsy blade making lotion application less efficient. The preferred embodiment of the blade member 7 as shown in FIGS. 1 and 2 is rectangular in shape, 3 inches (7.62 cm) by 4 inches (10.16 cm) and tapered to thin perimeter edges from a thicker center, as shown in FIG. 2.

The blade member 7 has a first side 8 and an opposing second side 9. As seen in FIG. 2, the second side 9 is generally a flat surface on which the lotion is applied by the user. The stiff blade perimeter edges of the blade member 7 allow a user to move quantities of lotion from one part of the body to another, as shown in FIG. 3. The silicone rubber compound blade member will not absorb the lotion applied to it, and will, because of its lack of absorbent quality, wipe clean and wash easily.

The present invention has been described with respect to certain preferred embodiments and conditions that are not meant to, and should not be, construed to limit the scope of the invention. Those skilled in the art will understand that variations from the embodiment and conditions described herein may be made without departing from the invention as defined in the appended claims. Any element in a claim that does not explicitly state "means for" performing a specific function, or "step for" performing a specific function, is not intended as a "means" or "step" clause as specified in 35 U.S.C. §112, ¶ 6.

I claim:

1. A lotion applicator device, comprising:

(a) an elongated handle having a first end and an opposing second end, said first end configured to be gripped by a user and said handle being of a length to enable the user to reach hard-to-reach areas of the user's body;

(b) an elastomeric substantially planar blade member connected to the second end of the handle, said blade member and the handle defining an obtuse angle therebetween, said blade member further comprising:

(i) said blade member being substantially rectangular in shape and including a proximal end adjacent the second end of the handle and an opposite distal end, said blade member further being substantially symmetrical about a plane passing through the longitudinal axis of the handle;

(ii) said blade member having first and second substantially parallel side edges extending from the proximal end toward the distal end and a distal edge at the distal end extending between the side edges, said distal edge including a substantially straight portion located in a central region between the side edges and further including a pair of curved portions at the ends of the distal edge adjacent a respective side edge; and (iii) said blade member having opposed first and second sides, each of the first and second sides taper from a thick central portion to each of the side edges and the distal edge, said thick central portion including a first portion adjacent the proximal end of the blade member and a second portion between the first portion and the tapered distal edge portion and the second portion having a thickness less than the first portion; and (c) whereby the user applies lotion applied to the second side of the blade member for spreading said lotion over hard-to-reach areas of the user's body.

2. The applicator device as set forth in claim 1, wherein:

(a) said blade member is made of a silicone rubber compound; and (b) said silicone rubber compound is made of 40 to 60 durometer value silicone rubber.

* * * * *